US005253608A

United States Patent [19]

Burke

[11] Patent Number: 5,253,608

[45] Date of Patent: Oct. 19, 1993

[54] FLAG POLE ASSEMBLY

[76] Inventor: Robert C. Burke, 618 Magnolia Ave., Charlotte, N.C. 28203

[21] Appl. No.: 865,556

[22] Filed: Apr. 8, 1992

[51] Int. Cl.[5] ..... G09F 17/00

[52] U.S. Cl. ..... 116/173; 248/538; 52/110

[58] Field of Search ..... 52/110, 111, 720, 728, 52/789, 294; 116/173, 174; D11/181, 182, 166; 248/538, 539; 40/606-608

[56] References Cited

U.S. PATENT DOCUMENTS

| | | | |
|---|---|---|---|
| 1,053,255 | 2/1913 | Ward | 248/539 |
| 1,815,353 | 7/1931 | Gerow et al. | 248/538 |
| 1,976,264 | 10/1934 | Miner et al. | 116/173 |
| 3,063,406 | 11/1962 | Slick | 116/173 |
| 3,178,139 | 4/1965 | McFarlin | 248/539 |
| 3,225,734 | 12/1965 | Bule | 116/173 |
| 3,242,901 | 3/1966 | Olson | D11/166 |
| 3,417,732 | 12/1968 | Platt, Jr. | 116/173 |
| 4,108,311 | 8/1978 | McClendon | 116/173 |
| 4,920,910 | 5/1990 | Lin | 116/173 |
| 4,986,209 | 1/1991 | Spica | 116/173 |
| 5,005,512 | 4/1991 | Fu | 116/173 |
| 5,042,419 | 8/1991 | Bianco | 116/173 |

*Primary Examiner*—Carl D. Friedman
*Assistant Examiner*—Winnie Yip
*Attorney, Agent, or Firm*—Shefte, Pinckney & Sawyer

[57] ABSTRACT

The present invention discloses a flag pole assembly having a bracket, a pole, a stopping member at one end of the pole, and a removable sleeve substantially the length of the pole which attaches to the flag. The sleeve is formed to slide onto and off the pole over its mounted end when removed from the bracket. In use, the sleeve is prevented from sliding off the outer end of the pole by the stopping member and, because of the length of the sleeve, the bracket retains the sleeve in place at its lower end. Thus, the flag and sleeve are easily removable as a unit from the pole once the pole is removed from the mounting bracket.

4 Claims, 3 Drawing Sheets

FLAG POLE ASSEMBLY

FIELD OF THE INVENTION

This invention relates to flag poles and, more particularly, to flag poles having means for easy interchange of various flags thereon.

BACKGROUND OF THE INVENTION

The display of flags enjoys virtual universal popularity. Until recently, these flags have been typically nationalistic flags, such as the United States flag. However, "decorative" flags have become popular in recent years displaying such things as seasonal or holiday themes. Frequently, persons displaying flags desire to change the flag being displayed depending upon the season of the year or holiday.

The raising or lowering of such flags can be a time consuming and frustrating operation due to the necessity of disconnecting the flag being displayed and reconnecting the flag desired to be displayed. Presently, there are no flag pole assemblies available providing for quick, easy, uncomplicated removal and exchange of flags.

Another source of frustration in displaying flags, particularly on inclined rather than upright flag poles, is the tendency of flags to become wrapped about the pole when blown by wind. It is known to address this problem to provide a rotatable sleeve permanently secured on the flag pole at its outer end by nonremovable retaining members. While such flag pole assemblies are generally effective for their intended purpose, they still suffer the disadvantage of being time consuming and annoying in attaching and removing flags.

SUMMARY OF THE INVENTION

It is therefore an object of the present invention to provide a flag pole assembly which facilitates the exchange of flags on a flag pole.

It is yet another object of the present invention to provide for a flag pole assembly which color coordinates with the flag desired to be displayed.

These and other objects of the present invention are accomplished via a flag pole assembly having a support bracket, a pole having a mounting end receivable by the bracket and an outer free end, a stopping member at the outer free end of the pole, and a sleeve for carrying a flag. The sleeve is of substantially the same length as the dimension of the pole between its mounting end and the stopping member and is formed to slide onto and off the pole over its mounting end when removed from the bracket. In use, the sleeve is prevented from sliding off the outer end of the pole by the stopping member. Because of the length of the sleeve, no retaining member is needed in the midsection of the pole to support the sleeve as was the case with prior flag pole assemblies. Thus, the flag and sleeve are easily removable and replaceable to and from the pole once the pole is removed from the mounting bracket.

The flag pole assembly may provide that the sleeve is tinted a color similar to the flag in order to coordinate the colors of the flag with the sleeve Additionally, the flag pole assembly may comprise a plurality of sleeves, each carrying a differing flag. Accordingly, the sleeves are easily exchanged on and off the pole to accommodate differing flags.

DESCRIPTION OF THE PREFERRED EMBODIMENT

Figure 1:
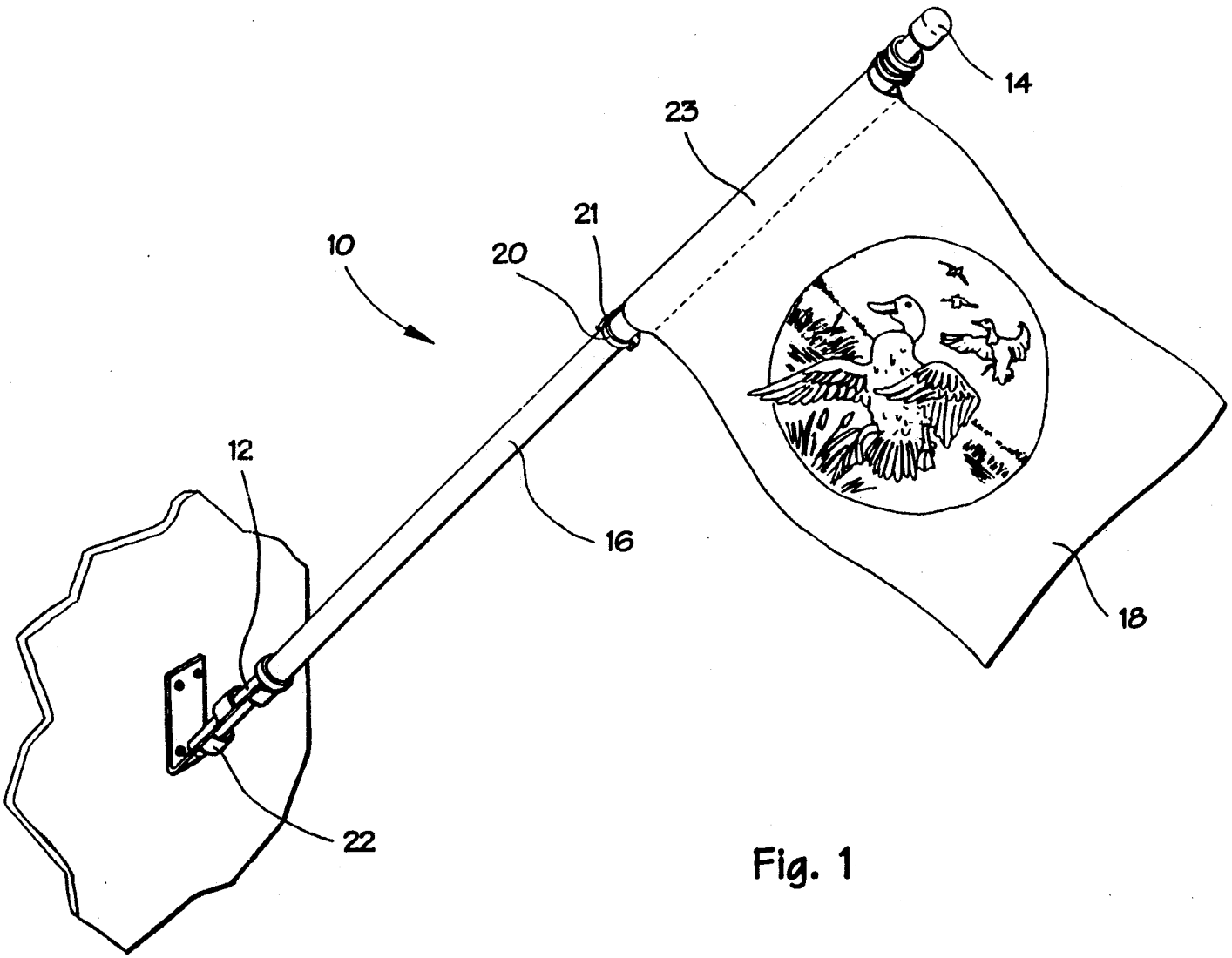
FIG. 1 illustrates the flag pole assembly of the present invention.
Figure 2:
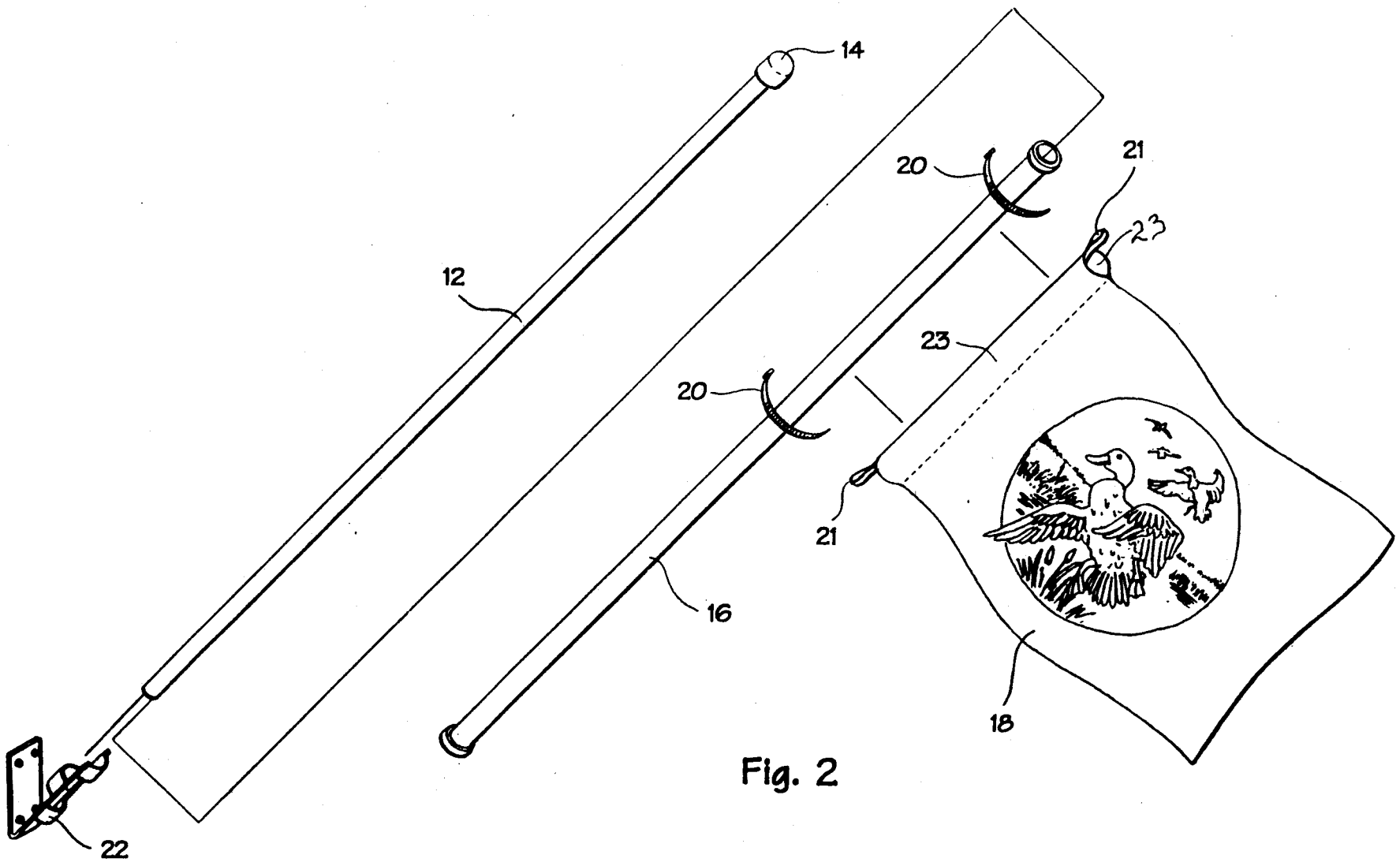
FIG. 2 is an exploded illustration of the flag pole assembly of the present invention.

Referring now to FIGS. 1 and 2, a flag pole assembly 10 of the present invention is shown. The assembly 10 consists of a flag pole 12, a stopping member 14 secured to the outer end of the pole 12, a removable sleeve member 16 rotatable about the pole 12 for carrying a flag 18, and a wall-mountable support bracket 22 for receiving the opposite inner end of the pole 12. Typically, the flag pole 12 is cylindrical in nature. In such instances, the sleeve member 16 is also cylindrical, but has a slightly larger diameter than the pole 12. The sleeve member 16 is preferably formed of plastic.

In order to facilitate the removal and exchange of flags from the pole 12, the sleeve 16 is substantially the same length as the dimension of the pole 12 between its end which mounts in the wall bracket 22 and the stopping member 14. The sleeve 16 is slidable onto and off the pole 12 over its mounting end when removed from the bracket 22. In use, the sleeve 16 rests against the bracket 22 and is thereby freely rotatable about the pole 12.

Preferably, flags 18 may be attached to sleeve 16 via attaching members 20 and tabs 21. Tabs 21 are formed inside the flag's sleeve pocket 23 at each end thereof. In order to attach the flag 18 to the sleeve 16, the sleeve 16 is inserted through the pocket 23 and the tabs 21 are manually pulled outward to extend from each end of the pocket 23. Once exposed, the tabs 21 are secured to the sleeve 16 via attaching members 20, preferably in the form of conventional plastic fastener ties, which are threaded through tabs 21 and wrapped around sleeve 16 and tightened. The tabs 21 are preferably made of leather to increase friction with the sleeve 16 thereby helping to maintain the flag position on the sleeve.

Of course, those persons skilled in the art will readily recognize that the flag assembly 10 of the present invention is equally applicable for mounting and displaying other forms of flags and banners, such as flags provided with grommets or eyelets at one edge of the flag rather than an edgewise pocket. In such case, the attaching members 20 are inserted through the grommets or eyelets and then wrapped and tightened about the sleeve 16 to secure the flag or banner thereon.

Figure 3:
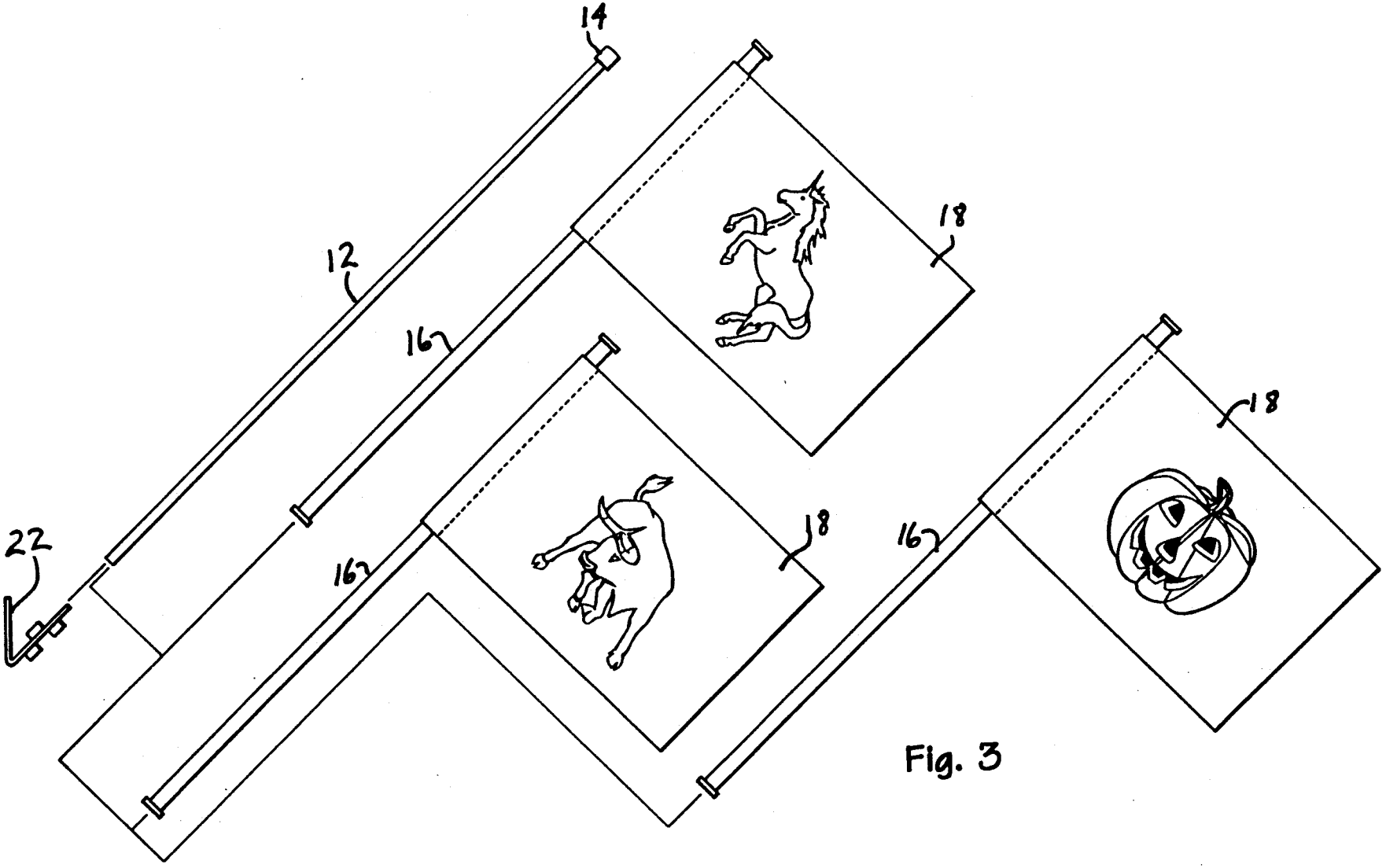
FIG. 3 is an exploded illustration of a flag pole assembly of the present invention having a plurality of sleeves and flags.

The flag assembly 10 may include just one sleeve 16 onto which various flags 18 may be attached via attaching members 20. Alternatively, there may be a plurality of sleeve members 16 each attached to its own flag 18 thereby further facilitating quick and easy replacement of flags on the flag pole 12 as seen in FIG. 3.

Advantageously, the sleeve member 16 may be tinted to coordinate the color of the sleeve member 16 with the color of the flag 18. Moreover, since the cylindrical sleeve member 16 is slightly larger in diameter than the pole 12, the sleeve member 16 can rotate around the flag pole 12, thereby preventing the flag 18 from wrapping around the flag pole 12 as is common with most traditional flag assemblies.

In summary, a novel flag pole assembly is disclosed featuring a sleeve member 16 which is easily removable to allow for flag replacement on the flag pole.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A flag pole assembly comprising:

(a) a support bracket;

(b) a pole having a mounting end selectively receivable by and removable from said bracket and an upper free end;

(c) a stopping member as said upper free end of said pole;

(d) at least one sleeve for carrying a flag, said sleeve being of a length substantially the same as the dimension of said pole between its said mounting end and said stopping member and formed to slide onto and off said pole over its mounting end when removed from said bracket; said stopping member having a greater diameter than a diameter of said sleeve; and (e) means for mounting the flag at lengthwise spaced apart locations on said sleeve with one mounting location being more closely adjacent said outer free end of said pole and the other mounting location being more closely adjacent said mounting end of said pole when said sleeve is disposed on said pole, whereby said flag and said sleeve are easily removable and replaceable as a unit to and from said pole over its mounting end.

2. The flag pole assembly of claim 1 wherein said sleeve is of a color coordinated to said flag.

3. The flag pole assembly of claim 1 wherein said at least one sleeve comprises a plurality of said sleeves each carrying a respective flag, whereby said sleeves and their respective flags are easily exchanged on said pole to accommodate the display of differing flags.

4. The flag pole assembly of claim 1 wherein said sleeve is of a length at length of said flag.

* * * * *

UNITED STATES PATENT AND TRADEMARK OFFICE

CERTIFICATE OF CORRECTION

PATENT NO. : 5,253,608

DATED : October 19, 1993

INVENTOR(S) : Robert C. Burke

It is certified that error appears in the above-identified patent and that said Letters Patent is hereby corrected as shown below:

Column 4, line 31, after "at" insert -- least twice the --.

Signed and Sealed this

Nineteenth Day of July, 1994

*Attest:*

*Attesting Officer*

BRUCE LEHMAN

*Commissioner of Patents and Trademarks*